US006062393A

United States Patent [19]

Knoll et al.

[11] Patent Number: 6,062,393

[45] Date of Patent: May 16, 2000

[54] PROCESS AND APPARATUS FOR SEPARATING PARTICLES OF DIFFERENT MAGNETIC SUSCEPTIBILITIES

[75] Inventors: Frank S. Knoll, Jacksonville, Fla.; Adrian Perregaux, Pittsburgh, Pa.; Joseph Boehm, Henley-on-Thames, United Kingdom

[73] Assignee: Carpco, Inc., Jacksonville, Fla.

[21] Appl. No.: 08/931,423

[22] Filed: Sep. 16, 1997

[51] Int. Cl.[7] ..... B03C 1/00

[52] U.S. Cl. ..... 209/219; 209/228; 209/11

[58] Field of Search ..... 209/215, 219, 209/221, 228, 231

[56] References Cited

U.S. PATENT DOCUMENTS

| | | | |
|---|---|---|---|
| 3,327,852 | 6/1967 | Mortsell | 209/219 |
| 3,737,822 | 6/1973 | Buus et al. | 209/219 X |
| 4,172,819 | 10/1979 | Mitchell et al. | 209/11 |
| 5,051,177 | 9/1991 | Dauchez | 209/219 X |
| 5,636,748 | 6/1997 | Arvidson | 209/228 X |
| 5,655,664 | 8/1997 | Barrett | 209/219 X |

*Primary Examiner*—Christopher P. Ellis
*Assistant Examiner*—Gene O. Crawford
*Attorney, Agent, or Firm*—Arthur G. Yeager

[57] ABSTRACT

A process and an apparatus for separating particles according to the strength of their magnetic susceptibilities includes a mass of loose particles transported on a moving surface over a plurality of long, thin, magnets separated by thin straps of ferromagnetic metal. The magnets are arranged such that the polarities of two adjacent magnets engaging opposite sides of the same ferromagnetic strap are identical. Particles are separated on the moving surface and when that surface passes around a horizontal axis, the particles fall off the surface into selected areas according to the magnetic susceptibilities of the particles. Cooling air flows between the moving surface and magnets to enhance operation and the useful life of the magnets.

14 Claims, 6 Drawing Sheets

PROCESS AND APPARATUS FOR SEPARATING PARTICLES OF DIFFERENT MAGNETIC SUSCEPTIBILITIES

TECHNICAL FIELD

This invention relates to the art of magnetic separation of different types of particles from each other according to their magnetic attraction; and more particularly, it relates to a process and apparatus wherein a moving surface supporting a bed of particles passes over a specially arranged array of permanent magnets causing particles as they pass vertically over a roll to cling to the surface for different lengths of time before falling off into different collection zones to effect a separation of particles according to their magnetic attraction properties.

BACKGROUND OF THE INVENTION

It has been known in the past that magnets can be used to attract ferrous materials and thereby can separate ferrous particles from a random mixture of such particles with other nonferrous materials. This knowledge has been expanded to produce machines that can continuously effect such a separation from a continuously moving bed of particles containing some ferrous materials. Improved procedures have been developed to enhance the power of permanent magnets so as to provide a better separation of the magnetically attracted materials from the remaining materials that are unaffected by magnetic fields. See, for example, U.S. Pat. Nos. 2,992,736 to Buus et al.; 3,146,191 to Greenwald; 3,678,427 to Morgan; 3,737,822 to Buus et al.; 4,728,419 to Grun; and 4,869,811 to Wolanski et al.

It has now been found that a more powerful magnetic force can be produced by special arrangements of permanent magnets that are alloys of rare earths, especially samarium and neodymium, with iron and other elements. In particular, these arrangements of permanent magnets involve placing the magnets in parallel rows, each row extending across and under the moving bed of particles and separated from the next adjacent row by a thin strip of low carbon steel or other ferromagnetic material, with the magnet rows being positioned with the same polarity (N or S) touching the single separator strip between adjacent magnets. Thus the arrangement might be graphically shown as—N-Mag 1-S/st1/S-Mag 2-N/st1/N-Mag 3-S/st1/S-Mag 4-N/st1/—(where Mag-1=Magnet No. 1; Mag-2=Magnet No. 2, etc.; N=North, S=South, and St1=steel strip). This arrangement might present a cylindrical shape over which a belt moves supporting the particles to be separated. The details of the invention will be more fully described in the following text and in the drawings.

BRIEF DESCRIPTION OF THE INVENTION

This invention relates to an apparatus and to a process for magnetic separation of particles according to their magnetic susceptibilities. The apparatus treats a thin volume of loose particles travelling on a moving support belt while the particles pass through a magnetic field generated by stationary rare earth magnets arranged in a plurality of parallel magnet strips extending lengthwise in a direction generally transverse to the direction of travel of the particles, each strip having two parallel longitudinal sides with opposite magnetic polarities. Adjacent magnet strips are separated by, and contiguous to opposite faces of a thin ferromagnetic separator strip magnetized to its saturation amount; and are positioned with their sides that touch opposite faces of a single separator strip having the same polarity. The support belt is positioned as close to the magnets as possible so that the particles on the belt pass through the maximum amount of magnetic flux, the polarity of which alternates from north to south and back to north repeatedly as the belt moves the particles over the parallel magnet strips. The magnetized particles cling to the belt while the nonmagnetized particles ride loosely on the belt. When the belt turns downward to reverse its direction of travel over the drum containing the stationary magnets, the nonmagnetized particles fall off as soon as they can slide off the belt, while the magnetized particles cling to the belt for a little longer time until gravity overcomes the force of the magnetic attraction, and then the magnetized particles fall off. This difference in time allows one to place a splitter in a position to catch the nonmagnetized particles on one side thereof and the magnetized particles on the other side thereof. It may be possible in certain embodiments to separate the particles into three or more fractions based on their relative magnetic strengths.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
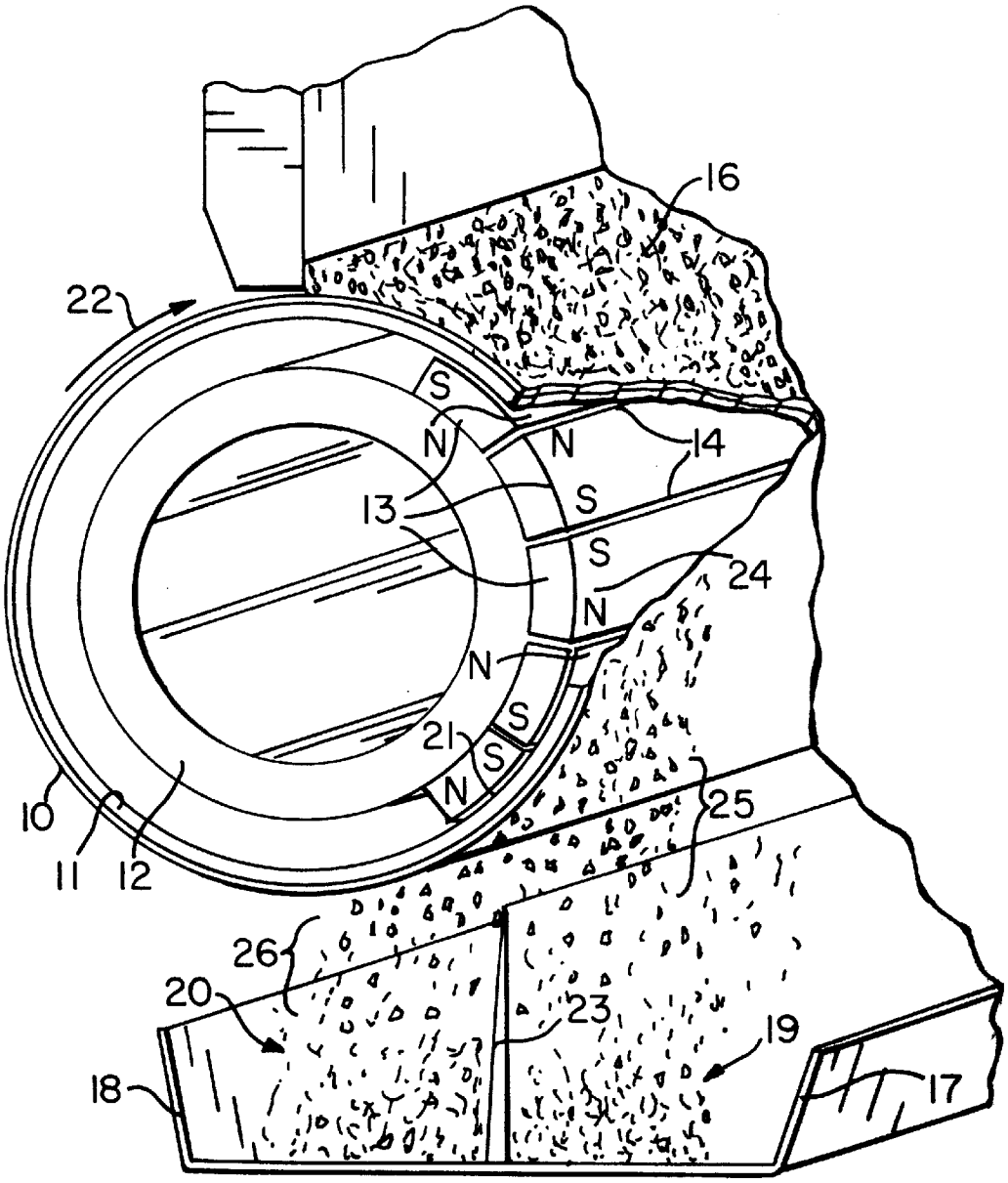
FIG. 1 is an illustration in perspective of the apparatus of this invention.

The invention is best understood by reference to the accompanying drawings showing the general features and working parts of this invention.

This invention involves a drum 11 which is preferably covered with a belt or shell 10 which rotates in the direction of arrow 22 by a driving mechanism (not shown). A mass of particles 16 is fed onto the moving surface by way of hopper 15 which feed the particles evenly across the entire width of drum 11 or width of shell 10. As these particles move along with the shell 10, they come under the influence of magnetic flux produced by stationary magnets 13 mounted on the outside surface of stationary drum 11 such that the outer surface of magnets 13 is close to the inner surface of shell 10. Each magnet 13 is separated from each adjacent magnet 13 by a thin separator strip or pole piece 14. Magnets 13 are mounted so as to cover only a portion of the external surface of drum 11. This portion is about 25–40% of the external surface of drum 11. The magnetic flux from magnets 13 acts upon all the particles 16 as they pass from feed hopper 15 to some point where they fall by gravity off the surface of belt 10 into collection bins 17 or 18 which are divided from each other by splitter 23. The masses of separated particles 19 and 20 may then be subjected to further processing as desired. Particles which are not magnetized will generally fall off the surface of belt 10 as soon as the force of gravity causes those particles to do so, e.g., at 25, normally when a tangent to the surface of belt 10 approaches and passes through a vertical position (in this drawing near 24). Particles which are magnetized will cling to belt 10 beyond the vertical tangent position 24 and fall off only when the force of gravity's pull exceeds the magnetic force holding the particle to belt 10, e.g., at 26. Splitter 23 is movable preferably so that it may be adjusted to catch whatever type of particle is desired. It may be desirable to employ two splitters 23 adjusted so as to separate the particles into three types, e.g., nonmagnetic, slightly magnetic, and strongly magnetic. It may also be advantageous to employ a wiper on the left-hand side of the drum 11 and belt 10 shown in the drawing so as to wipe off any dust or other material clinging to the surface after passing bin 18 so as to present a clean surface to those particles being fed onto the surface at feed hopper 15.

The magnets 13 are permanent magnets made of alloys of rare earths. Generally these magnetic alloys produce very strong magnetic fluxes. The alloys usually contain (1) a rare earth such as neodymium or samarium, (2) iron, and (3) a metal such as boron or cobalt. These magnets are known in the art and include alloys such as neodymium/iron/boron and samarium/iron/cobalt. It has been known that when such magnets are arranged with like polarities adjacent each other, e.g. -N-magnet-1-S-S Magnet-2-N-N- Magnet-3-S-S Magnet-4-N - that strong forces are produced where the like poles are close together. It has been found that this strength can be greatly enhanced by including a thin separator strip of a ferromagnetic material between and in contact with both magnets. The physical arrangement of this separator strip is important. Buus et al., U.S. Pat. No. 2,992,736 employs a double triangular arrangement to separate adjacent magnets. Morgan, U.S. Pat. No. 3,678,427 employs a triangular piece resting on a rectangular base to separate adjacent magnets. Greenwald, U.S. Pat. No. 3,146,191 employs a single triangular separator between adjacent magnets. It has now been found that the greatest magnetic flux density occurs when strip magnets are separated by a thin strip or a combination of more than one thin strip of a ferromagnetic metal which have been magnetized to a saturation level, usually to 2 tesla (20,000 gauss) and in contact with both of the magnets, these two magnets having the same polarity where they contact the separator strip. The separator strip or pole piece 14 preferably is made of sintered steel with a carbon content of less than 0.15%. While other materials are useful, they are not preferred. The best materials are those which have a high magnetization at the saturation level. Low carbon steel can reach more than 2 tesla while pure nickel can reach only about 0.5 tesla. No air gap between the pole pieces should be permitted because this will reduce the field intensity. It has been found that the best results are obtained when the separator strip is a thin strip of the same thickness from end to end. The triangular pieces of the prior art do not provide the best field intensity. The exact thickness of the separator strip 14 is important since thick strips are not easily saturated magnetically, while thin strips tend to let the magnetic flux of one magnet leak through to the other magnet to provide a repulsion effect. It may be necessary to test different sizes to be able to choose the most desirable thickness. Generally this thickness of pole piece 14 preferably should be about 4 mm.

The stationary supporting structure, including tube 12, should be nonmagnetic so as to be unaffected by magnets 13. A typical material might be stainless, aluminum or plastic. Similarly, hopper 15, splitter 23, and bins 17 and 18 are preferably nonmagnetic materials so as not to interfere with the particle separation procedure.

Although the structure shown in the drawing shows a single cylindrical drum; it is not important that this be so. There might be two spaced drums connected by belt 10, one of the drums being driven by a motor and the other functioning as the separator drum similar to that described above. Still another modification relates to the size of magnets 13. These may be very narrow between poles and very thin in a radial direction. There is, of course, a limit to such reductions in width and thickness since the magnetic flux from the poles may interfere if opposite polarities are two close together.

Figure 2:
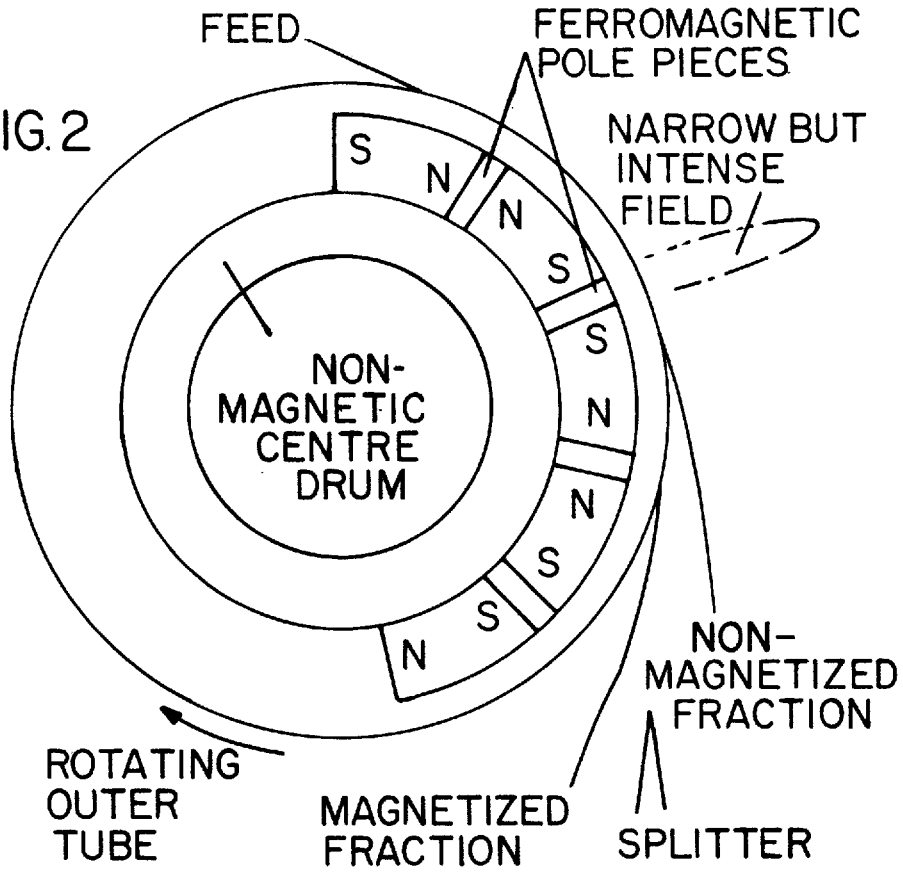
FIG. 2 is a schematic illustration of the intense magnetic field developed by the process and apparatus of this invention.
Figure 3:
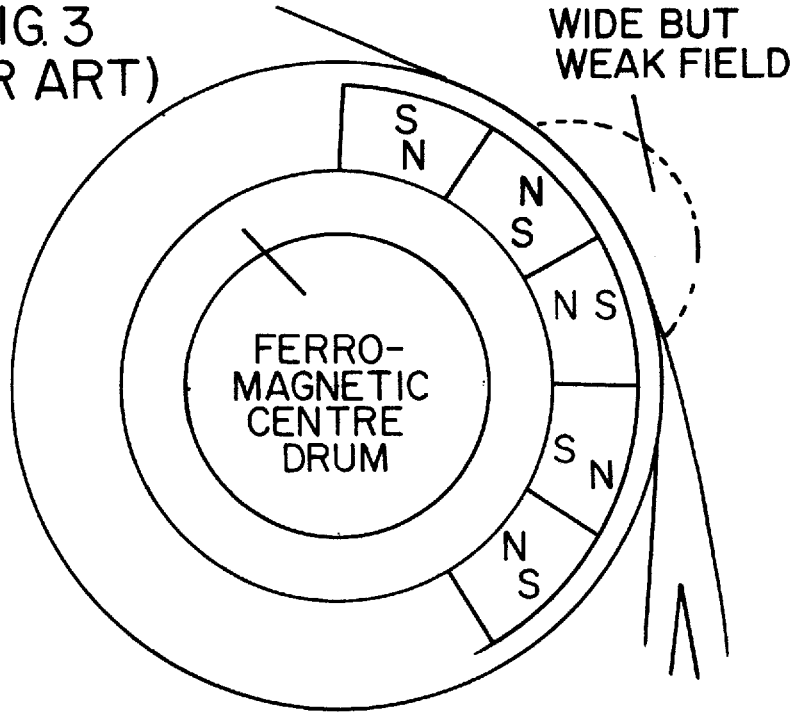
FIG. 3 (PRIOR ART)
FIG. 3 is a schematic illustration of the weaker but broader magnetic field developed by a prior art arrangement.
Figure 4:
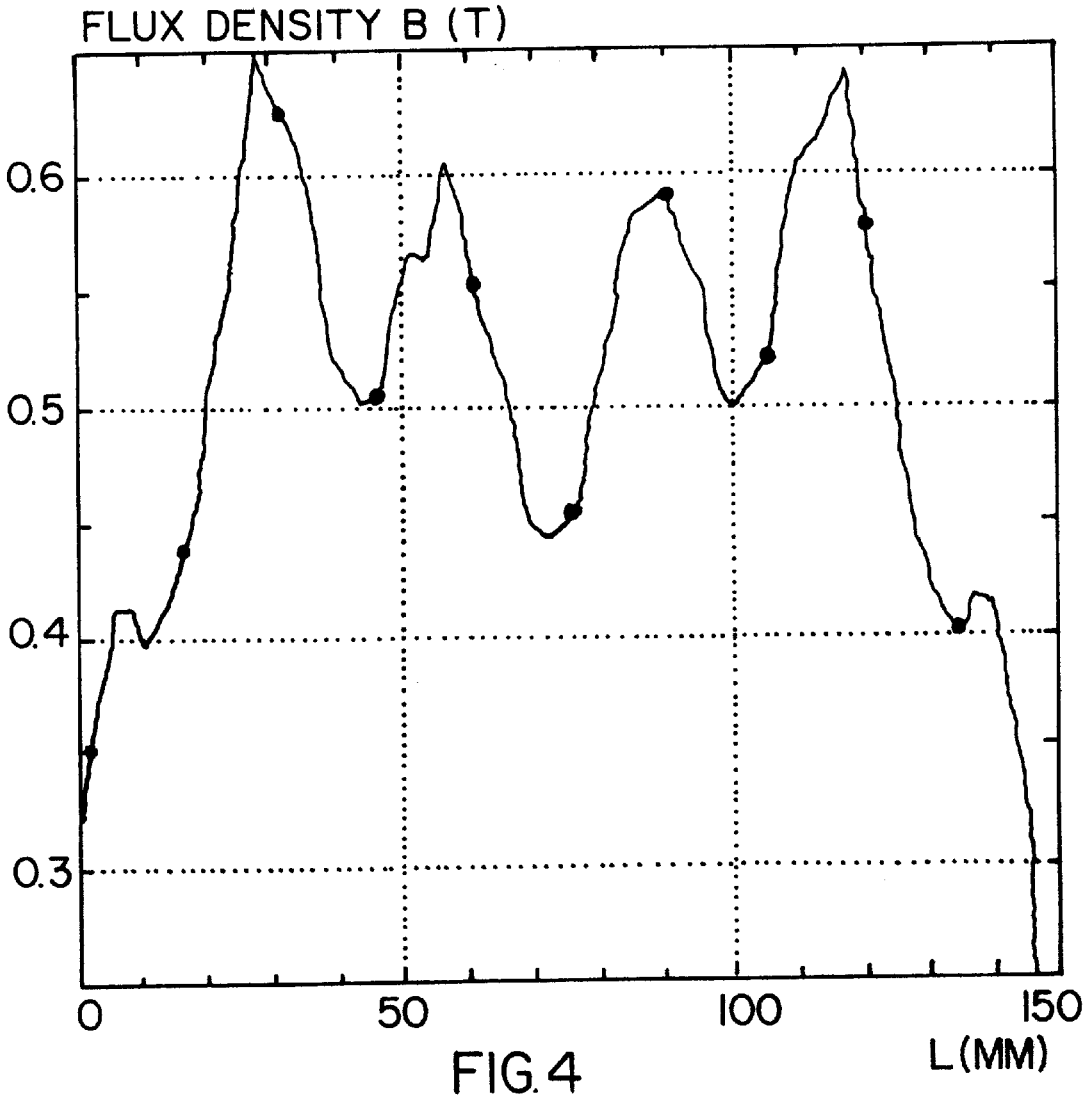
FIG. 4 (PRIOR ART)
FIG. 4 is a graphical representation of the field intensity developed by the arrangement of FIG. 3.
Figure 5:
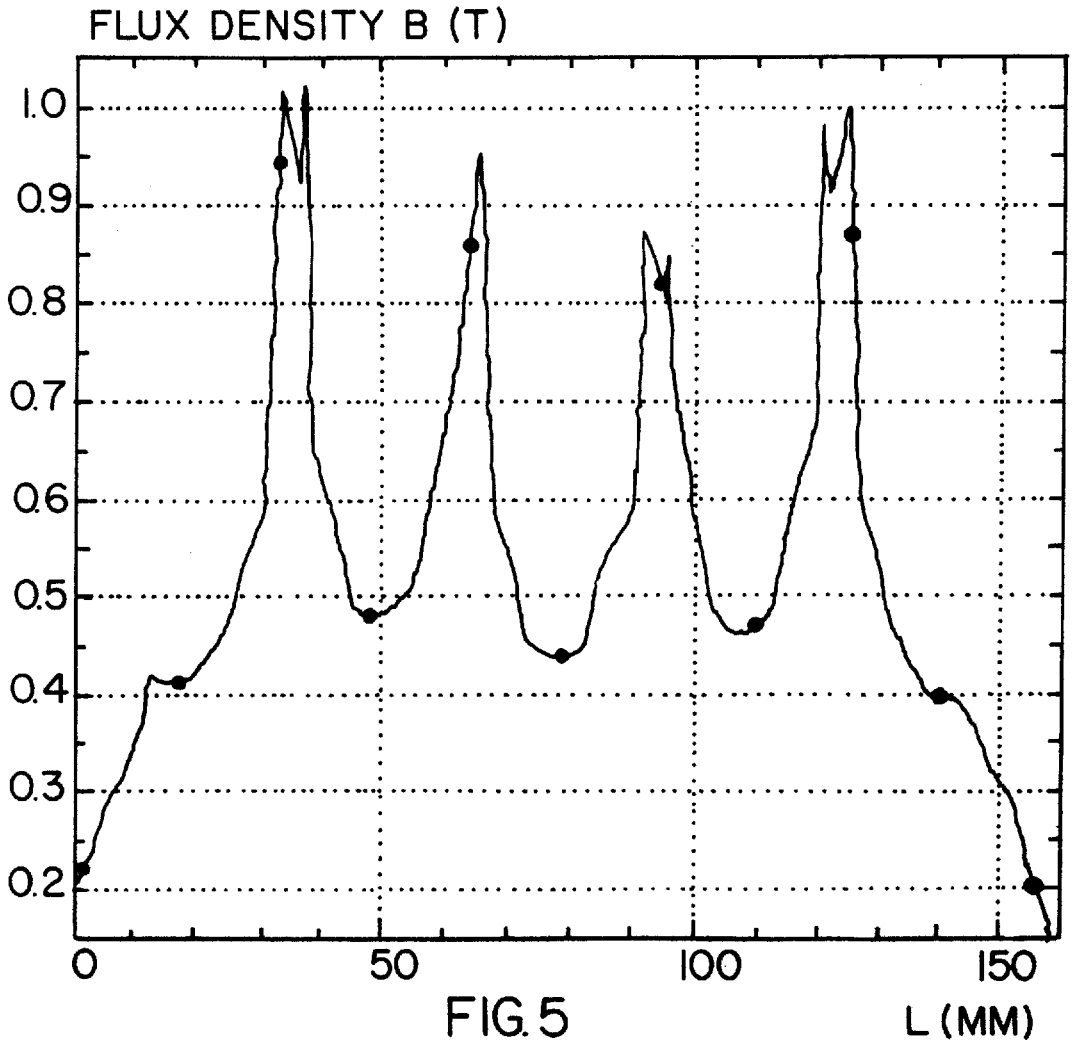
FIG. 5 is a graphical representation of the field intensity developed by the process and apparatus of FIGS. 1 and 2 of this invention.

In the drawings FIGS. 2–5 show comparisons between the prior art (FIGS. 3 and 4) and the present invention (FIGS. 2 and 5). In FIG. 2 there is shown a very intense, narrow field of magnetism which is produced at every junction between adjoining magnets with polarities being the same at the junction, i.e., at the places where adjacent magnets 13 touch opposite sides of the same separator strip 14 in FIG. 1. The intense field is shown in FIG. 2 as being narrow but large in magnitude. As may be seen in FIG. 5 the graph shows intensities of 0.82 to 0.95 at four separate points. In contrast to this the arrangement of FIG. 3 having alternating polarities on adjacent magnets produces (FIG. 4) only field intensities of 0.45 to 0.58 at the same general spacings as those in FIG. 5. The field intensity is almost twice as much in FIG. 5 as those in FIG. 4. Nothing in the prior art shows such increases in field intensity.

Figure 6:
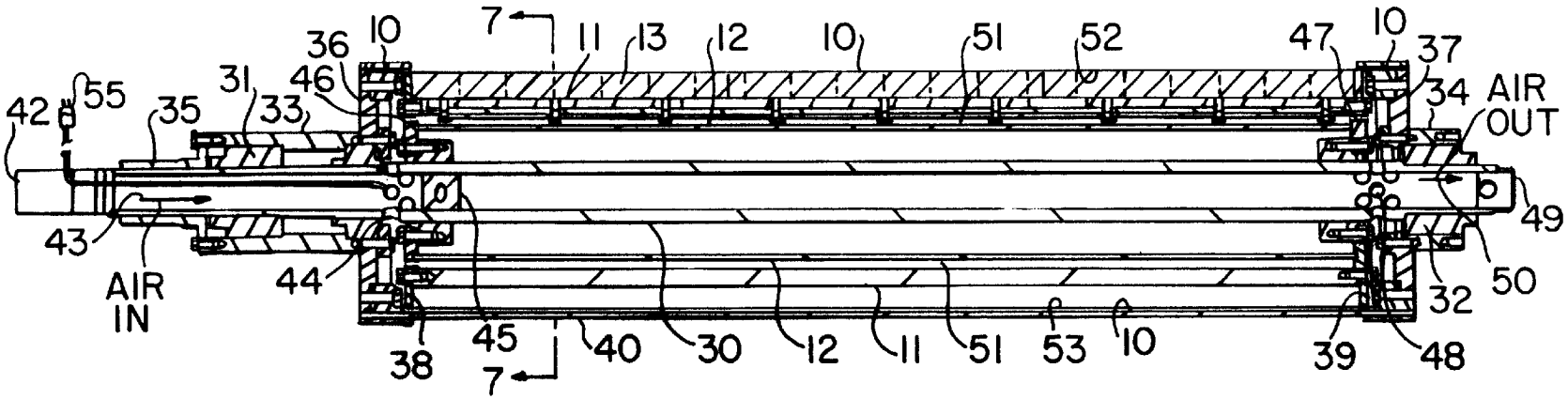
FIG. 6 is a longitudinal cross-sectional view of the magnetic apparatus shown in FIG. 1.
Figure 7:
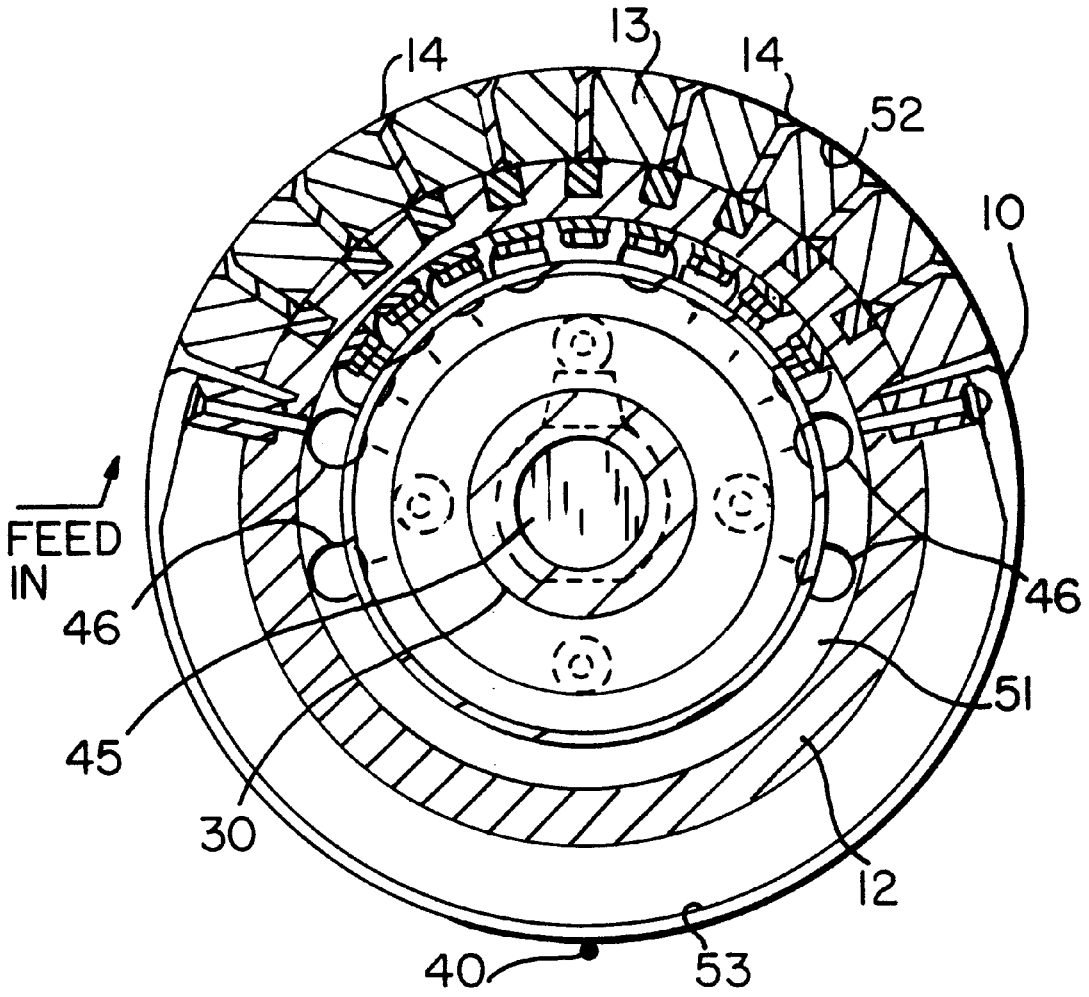
FIG. 7 is a transverse cross-sectional view taken along line 7—7 of FIG. 6.

The cooling system for the apparatus is clearly shown in FIGS. 6 and 7, as well as the constructional details of the stationary drum 11 and tube 12 and rotating shell 10. The shaft 30 is stationary and supports a pair of spaced bearings 31 and 32 about which sleeves 33 and 34 rotate by a suitable drive (not shown) coupled at drive connection 35 for rotating spaced outer vertical plates 36 and 37 which support shell 10 for rotation therewith. The shaft 30 supports spaced inner vertical plates 38 and 39 by which drum 11 and tube 12 are supported within outer rotating shell 10 and outer plates 36 and 37. An elongated rod 40 extends between outer plates 36 and 37 and is affixed to each for rotation therewith. Rod 40 is employed to cooperate with another element (not shown) to assure removal of any particles from the shell 10 prior to any additional feed thereon. It is noted that the orientation of FIG. 7 should be rotated 90° clockwise to obtain the orientation thereof depicted in FIG. 1.

Cooling air is blown into the hollow shaft end 42 in the direction of arrow 43 from a suitable blower (not shown) and thence through transverse bores 44 in the shaft 30 between outer and inner plates 36 and 38, shaft 30 being stopped by plug 45. A plurality of spaced openings 46 pass through inner plate 38 to permit cooling air to pass through passageway 51 between tube 12 and drum 10, to which the magnets 13 are affixed, and thence through spaced openings 47 in inner plate 39 and spaced bores 48 in shaft 30 and out the opposite end 49 thereof in the direction of arrow 50.

Between the outer faces of the magnets 13 and shell 10 is an air passageway or gap 52, on the order of 0.0012 mm, and cooling air also travels from between outer and inner plates 36 and 38 through the passageway 52 and thence between inner and outer plates 39 and 37 and out via bores 48 and end 49. Also the air travels through passageway 53 from between plates 36 and 38 to and between plates 39 and 37 and out bores 48 and shaft end 49.

A thermocouple lead 55 is appropriately located in the apparatus to sense the temperature within the shell 10 to enable control of the volume and/or temperature of the incoming air to maintain the temperature of the magnets 13 below about 150° F. Magnet temperatures above about 200° F. would be detrimental to the magnets 13 and to the effectiveness of the apparatus in accord with this invention.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An apparatus for magnetic separation of particles comprising a moving bed over which a thin volume of loose particles is transported through a magnetic field, a cylindrical arrangement of rare earth magnets generates said magnetic field to effect a separation between less magnetically attracted particles from more magnetically attracted particles; the improvement which comprises:

(a) said cylindrical arrangement of rare earth magnets being formed by a plurality of closely positioned parallel strings of magnets extending lengthwise in a direction generally transverse to the direction of movement of said loose particles on said bed, and wherein each said string of magnets has its two longitudinal sides magnetized with opposite polarities said sides being substantially planar and distanced apart to provide each said string of magnets with a substantial width;

(b) a plurality of central thin ferromagnetic strips each magnetized to its saturation amount and being respectively sandwiched between adjacent said strings of magnets, said strips being substantially thinner than said width of said string of magnets;

(c) each of said strings of magnets being supported on a non-magnetically attractive frame;

(d) said strings of magnets geing arranged such that the polarity of the sides of two said strings touching a single ferromagnetic strip is idnetical; and (e) means for circulating cooling air between said moving bed and said rare earth magnets.

2. The apparatus of claim 1 wherein each said ferromagnetic strip is magnetized to a value of about 2 tesla.

3. The apparatus of claim 1 wherein said ferromagnetic strip is a low carbon steel having a carbon content of less than 0.15%.

4. The apparatus of claim 1 wherein said rare earth magnets are alloys of samarium or neodymium with iron.

5. The apparatus of claim 4 wherein said alloy is neodymium/boron/iron.

6. The apparatus of claim 4 wherein said alloy is samarium/iron/cobalt.

7. The apparatus of claim 1 wherein said moving bed is a thin-walled rotating shell of non-ferromagnetic material spaced about 0.0012 mm from adjacent surfaces of said rare earth magnets.

8. The apparatus of claim 7 wherein said thin-walled shell is made of stainless steel.

9. The apparatus of claim 7 wherein said thin-walled shell is made of carbon fiber.

10. A continuous process for separating particles according to the strength of their magnetic attractiveness, which comprises feeding a thin bed of loose particles having different degrees of magnetic attraction onto a moving surface under which is a stationary arrangement of magnets producing a high magnetic flux density capable of producing a large coercive force on said bed of particles, said magnets being oriented with the polar axis of each magnet being generally parallel to the direction of travel of said moving surface, said feeding including passing said bed of particles through said magnetic flux which said moving surface travels in a convexly curving downward path with said particles falling from said moving surface at different locations depending on the magnetic strength of each particle to cling to said surface; and allowing said falling particles to be separated by means of one or more splitters positioned selectively to divide particles of less magnetic strength from those of greater magnetic strength said moving surface being spaced about 0.0012 mm from adjacent surfaces of said magnets; said magnets being arranged in parallel lengths with ferromagnetic thin strips being touchingly sandwiched between adjacent said parallel magnet lengths; each said length having two long parallel sides of opposite magnetic polarities and said sides being substantially greater than said thin thickness of each said strip, said ferromagnetic thin strip being about 4 mm in thickness to readily become saturated magnetically by adjacent said magnets without magnetic flux leakage between said magnets, the polarity of adjacent sides of two adjacent said lengths touching opposite sides of the same ferromagnetic thin strip being the same.

11. The process of claim 10 wherein each said magnet is a long slender strip having a length substantially as long as the width of said moving surface measured perpendicular to the direction of movement of said surface.

12. The process of claim 10 wherein said moving surface is non-magnetically attractive.

13. The process of claim 10 further comprising passing cooling air between said moving surface and said magnets to maintain said magnets below about 150° F.

14. A continuous process for separating particles according to the strength of their magnetic attractiveness, which comprises feeding a thin bed of loose particles having different degrees of magnetic attraction onto a moving surface under which is a stationary arrangement of magnets producing a high magnetic flux density capable of producing a large coercive force on said bed of particles, said magnets being oriented with the polar axis of each magnet being generally parallel to the direction of travel of said moving surface, said feeding including passing said bed of particles through said magnetic flux which said moving surface travels in a convexly curving downward path with said particles falling from said moving surface at different locations depending on the magnetic strength of each particle to cling to said surface; and allowing said falling particles to be separated by means of one or more splitters positioned selectively to divide particles of less magnetic strength from those of greater magnetic strength said moving surface being spaced about 0.0012 mm from adjacent surfaces of said magnets; said magnets being arranged in parallel lengths with ferromagnetic thin strips being touchingly sandwiched between adjacent said parallel magnet lengths; each said length having two long parallel sides of opposite magnetic polarities and said sides being substantially greater than said thin thickness of each said strip, the polarity of adjacent sides of two adjacent said lengths touching opposite sides of the same ferromagnetic thin strip being the same, passing cooling air between said moving surface and said magnets to maintain said magnets below about 150 degrees F.

* * * * *